US009818341B2

(12) United States Patent
Kwon et al.

(10) Patent No.: US 9,818,341 B2
(45) Date of Patent: Nov. 14, 2017

(54) ORGANIC LIGHT-EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Oh Jo Kwon, Suwon-si (KR); Kyung Youl Min, Hwaseong-si (KR); Choong Sun Shin, Yongin-si (KR); Young Uk Won, Cheongju-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 254 days.

(21) Appl. No.: 14/660,808

(22) Filed: Mar. 17, 2015

(65) Prior Publication Data

US 2016/0155380 A1 Jun. 2, 2016

(30) Foreign Application Priority Data

Dec. 1, 2014 (KR) ..... 10-2014-0169784

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01);
(Continued)

(58) Field of Classification Search
CPC .... G09G 3/30–3/3208; G09G 3/3225–3/3258; G09G 3/3275–3/3291;
(Continued)

(56) References Cited

U.S. PATENT DOCUMENTS 8,115,707 B2 2/2012 Nathan et al.
2009/0213049 A1 * 8/2009 McCreary ..... G09G 3/3233 345/80

(Continued)

FOREIGN PATENT DOCUMENTS

KR 10-2009-0129336 A 12/2009
KR 10-2011-0008774 A 1/2011

(Continued)

OTHER PUBLICATIONS

Abstract of Non-Patent Literature Chaji, G.R. et al., A Current-Mode Comparator for Digital Calibration of Amorphous Silicon AMOLED Displays, Circuits and Systems II: Express Briefs, IEEE Transactions, 2008, 1 Page, vol. 55, Issue 7, IEEE.

*Primary Examiner* — David Tung
(74) *Attorney, Agent, or Firm* — Lewis Roca Rothgerber Christie LLP

(57) ABSTRACT

An organic light-emitting display device includes: pixels; and a data driver including a plurality of current measurers connected to the pixels via at least one data line, each of the current measurers including: a first measurement circuit including: a first operational amplifier including a non-inverted input terminal to which a first reference voltage is applied, and an inverted input terminal connected to a first pixel from among the pixels; and a first feedback capacitor connected between the inverted input terminal and an output terminal of the first operational amplifier; and a second measurement circuit including: a second operational amplifier including a non-inverted input terminal to which a second reference voltage is applied, and an inverted input terminal connected to a second pixel from among the pixels; and a second feedback capacitor connected between the inverted input terminal and an output terminal of the second operational amplifier.

15 Claims, 9 Drawing Sheets

(52) U.S. Cl.
CPC ..... *G09G 2300/0842* (2013.01); *G09G 2300/0861* (2013.01); *G09G 2310/0291* (2013.01); *G09G 2320/0295* (2013.01)

(58) Field of Classification Search
CPC ..... G09G 2320/043–2320/048; G09G 2300/0819; G09G 2300/0842; G09G 2300/0861; G09G 2310/0291
See application file for complete search history.

(56) References Cited

U.S. PATENT DOCUMENTS

| | | | | |
|---|---|---|---|---|
| 2011/0130981 | A1 | 6/2011 | Chaji et al. | |
| 2011/0157134 | A1* | 6/2011 | Ogura | G09G 3/20 345/211 |
| 2011/0254871 | A1* | 10/2011 | Yoo | G09G 3/3233 345/690 |
| 2011/0279444 | A1* | 11/2011 | Chung | G09G 3/3233 345/214 |
| 2013/0050292 | A1* | 2/2013 | Mizukoshi | G09G 3/3291 345/690 |

FOREIGN PATENT DOCUMENTS

| | | | |
|---|---|---|---|
| KR | 10-2012-0012597 | A | 2/2012 |
| KR | 10-2013-0024744 | A | 3/2013 |

* cited by examiner

ORGANIC LIGHT-EMITTING DISPLAY DEVICE AND METHOD OF DRIVING THE SAME

CROSS-REFERENCE TO RELATED APPLICATION

This application claims priority to and the benefit of Korean Patent Application No. 10-2014-0169784 filed on Dec. 1, 2014 in the Korean Intellectual Property Office, the disclosure of which is incorporated herein by reference in its entirety.

BACKGROUND

1. Field

One or more embodiments of the present invention relate to an organic light-emitting display device and a method of driving the same.

2. Description of the Related Art

Organic light-emitting display devices, which have been increasingly highlighted as next-generation display devices, display an image by using organic light-emitting diodes (OLEDs), which generate light through the recombination of electrons and holes. Organic light-emitting display devices provide fast response speeds, high luminance, wide viewing angles, and low power consumption.

More specifically, an organic light-emitting display device uses driving transistors included in pixels to control the amount of current provided to OLEDs, and the OLEDs generate light with a luminance based on the amount of current provided thereto.

OLEDs deteriorate over time in proportion with the amount of time of use thereof, thereby lowering display luminance. Further, due to the differences among the threshold voltages of the driving transistors of pixels or the differences among the levels of deterioration of OLEDs, differences may occur among the luminance of the pixels. As such, luminance imbalance may become severe, image sticking may occur, and as a result, the quality of display may deteriorate.

The above information disclosed in this Background section is only for enhancement of understanding of the background of the present invention, and therefore, it may contain information that does not form prior.

SUMMARY

Some aspects of exemplary embodiments of the invention provide an organic light-emitting display device capable of precisely measuring a current from each pixel with the use of a simple structure to compensate for any differences among the luminance of the pixels.

However, the present invention is not restricted to the exemplary embodiments set forth herein. The above and other aspects of the invention will become more apparent to one of ordinary skill in the art to which the invention pertains by referencing the detailed description of the invention given below.

According to an exemplary embodiment of the invention, an organic light-emitting display device includes: a plurality of pixels, each of the pixels including an organic light-emitting diode (OLED); and a data driver including a plurality of current measurers connected to the plurality of pixels via at least one data line, each of the current measurers including: a first measurement circuit including: a first operational amplifier including a non-inverted input terminal to which a first reference voltage is applied, and an inverted input terminal connected to a first pixel from among the plurality of pixels; and a first feedback capacitor connected between the inverted input terminal and an output terminal of the first operational amplifier; and a second measurement circuit including: a second operational amplifier including a non-inverted input terminal to which a second reference voltage having a different level from that of the first reference voltage is applied, and an inverted input terminal connected to a second pixel from among the plurality of pixels; and a second feedback capacitor connected between the inverted input terminal and an output terminal of the second operational amplifier.

Each of the current measurers may further include a correlated double sampling unit connected to the output terminals of the first and second operational amplifiers.

The data driver may further include a data processor including: an analog-to-digital converter (ADC) configured to convert an output of the correlated double sampling unit into digital data; and a multiplexer connected between the correlated double sampling unit and the ADC.

The first measurement circuit may further include a first feedback switch connected in parallel to the first feedback capacitor between the inverted input terminal and the output terminal of the first operational amplifier; and the second measurement circuit may further include a second feedback switch connected in parallel to the second feedback capacitor between the inverted input terminal and the output terminal of the second operational amplifier.

The first measurement circuit may further include a first switch connected between the first pixel and the inverted input terminal of the first operational amplifier; and the second measurement circuit may further include a second switch connected between the second pixel and the inverted input terminal of the second operational amplifier.

Each of the plurality of pixels may include: a driving transistor including a first electrode connected to a first power source, and a second electrode connected to a second power source via the OLED that is connected to a first node; a switching transistor including a first electrode connected to the data line, a second electrode connected to a gate electrode of the driving transistor, and a gate electrode connected to a scan line; a sensing transistor including a first electrode connected to the data line, a second electrode connected to the first node, and a gate electrode connected to a sensing line; and a first capacitor including a first terminal connected to the first electrode of the driving transistor, and a second terminal connected to the gate electrode of the driving transistor.

The first reference voltage may be greater than or equal to a threshold voltage of the OLED, and the second reference voltage may be less than the threshold voltage of the OLED.

The organic light-emitting display device may further include: a power supply connected to the first and second power sources via power lines, and each of the current measures may further include: a first initialization switch connected between the power supply and the data line connected to the plurality of pixels; and a second initialization switch connected between the power supply and the first electrode of the switching transistor.

Each of the plurality of pixels may further include a power switch connected between a power line connected to the first electrode of the driving transistor and the first and second power sources.

According to another exemplary embodiment of the invention, an organic light-emitting display device includes: a plurality of pixels, each of the pixels including an OLED;

and a data driver including a plurality of current measurers configured to measure a current flowing in each of the plurality of pixels during a sensing period, each of the current measures being further configured to: apply a first reference voltage to an anode electrode of an OLED included in a first pixel from among the plurality of pixels and a second reference voltage, which has a different level from that of the first reference voltage, to an anode electrode of an OLED included in a second pixel from among the plurality of pixels, during a reference voltage supply period of the sensing period; and measure a first measurement voltage corresponding to a current flowing in the first pixel to which the first reference voltage is applied and a second measurement voltage corresponding to a current flowing in the second pixel to which the second reference voltage is applied, during a measurement period of the sensing period, which follows the reference voltage supply period.

Each of the current measurers may include: a first measurement circuit including: a first operational amplifier including a non-inverted input terminal to which the first reference voltage is applied, and an inverted input terminal connected to the first pixel; a first feedback capacitor connected between the inverted input terminal and an output terminal of the first operational amplifier; and a first feedback switch connected in parallel to the first feedback capacitor between the inverted input terminal and the output terminal of the first operational amplifier; a second measurement circuit including: a second operational amplifier including a non-inverted input terminal to which the second reference voltage is applied, and an inverted input terminal connected to the second pixel; a second feedback capacitor connected between the inverted input terminal and an output terminal of the second operational amplifier; and a second feedback switch connected in parallel to the second feedback capacitor between the inverted input terminal and the output terminal of the second operational amplifier; and a correlated double sampler configured to perform correlated double sampling (CDS) on the first and second measurement voltages provided at the output terminals of the first and second operational amplifiers, respectively.

The data driver may further include: a data processor including an ADC configured to convert an output of the correlated double sampler into digital data, and a multiplexer configured to provide the output of the correlated double sampler to the ADC via a switching operation; and a data driving circuit configured to provide a data signal to the plurality of pixels during a display period.

The first measurement circuit may further include a first switch connected between the first pixel and the inverted input terminal of the first operational amplifier; the second measurement circuit may further include a second switch connected between the second pixel and the inverted input terminal of the second operational amplifier; and the data driving circuit may include a plurality of digital-to-analog converters (DACs) configured to provide the data signal to a data line, and a plurality of third switches connected between the plurality of pixels and the DACs.

Each of the plurality of pixels may include: a driving transistor configured to control a driving current flowing in the OLED connected between a first power source and a second power source;

a switching transistor configured to provide a data signal provided via a data line to a gate electrode of the driving transistor according to a scan signal provided to a gate electrode of the switching transistor; a sensing transistor configured to measure a current flowing in the OLED according to a sensing signal provided to a gate electrode of the sensing transistor; and a first capacitor including a first terminal connected to a second electrode of the driving transistor, and a second terminal connected to the gate electrode of the driving transistor.

The first reference voltage may be greater than or equal to a threshold voltage of the OLED, and the second reference voltage may be less than the threshold voltage of the OLED.

The organic light-emitting display device may further include: a power supply configured to charge the data line with a first initialization voltage during a first initialization period of the sensing period, and to charge the first capacitor with a second initialization voltage during a second initialization period of the sensing period, which follows the first initialization period.

Each of the plurality of pixels may further include a power switch configured to connect a power line connected to the first power source to the second power source via a switching operation.

According to another exemplary embodiment of the invention, a method of driving an organic light-emitting display device includes: during a reference voltage supply period of a sensing period, applying a first reference voltage to an anode electrode of an OLED included in a first pixel from among a plurality of pixels, and applying a second reference voltage, which has a different level from that of the first reference voltage, to an anode electrode of an OLED included in a second pixel from among the plurality of pixels; and during a measurement period of the sensing period, which follows the reference voltage supply period, measuring a first measurement voltage corresponding to a current flowing in the first pixel to which the first reference voltage is applied, and measuring a second measurement voltage corresponding to a current flowing in the second pixel to which the second reference voltage is applied.

The method may further include: performing CDS on the first and second measurement voltages; and converting a result of the CDS into digital data.

The method may further include: connecting a power line connected to a first power source to a second power source via a switching operation; charging at least one data line with a first initialization voltage during a first initialization period of the sensing period; and charging first capacitors of the first and second pixels with a second initialization voltage during a second initialization period of the sensing period, which follows the first initialization period.

According to the exemplary embodiments, it may be possible to precisely measure a current from each pixel with the use of a simple structure. Accordingly, it may be possible to realize a uniform quality of display by compensating for any differences among the levels of deterioration of the pixels.

Also, it may be possible to improve the precision of the measurement of a current through differential sensing and correlated double sampling (CDS).

Other aspects and features of the present invention will be apparent from the following detailed description, drawings, and claims, and their equivalents.

BRIEF DESCRIPTION OF THE DRAWINGS

The above and other aspects and features of the present invention will become more apparent by the described detail of the embodiments thereof with reference to the attached drawings in which.

DETAILED DESCRIPTION

Figure 1:
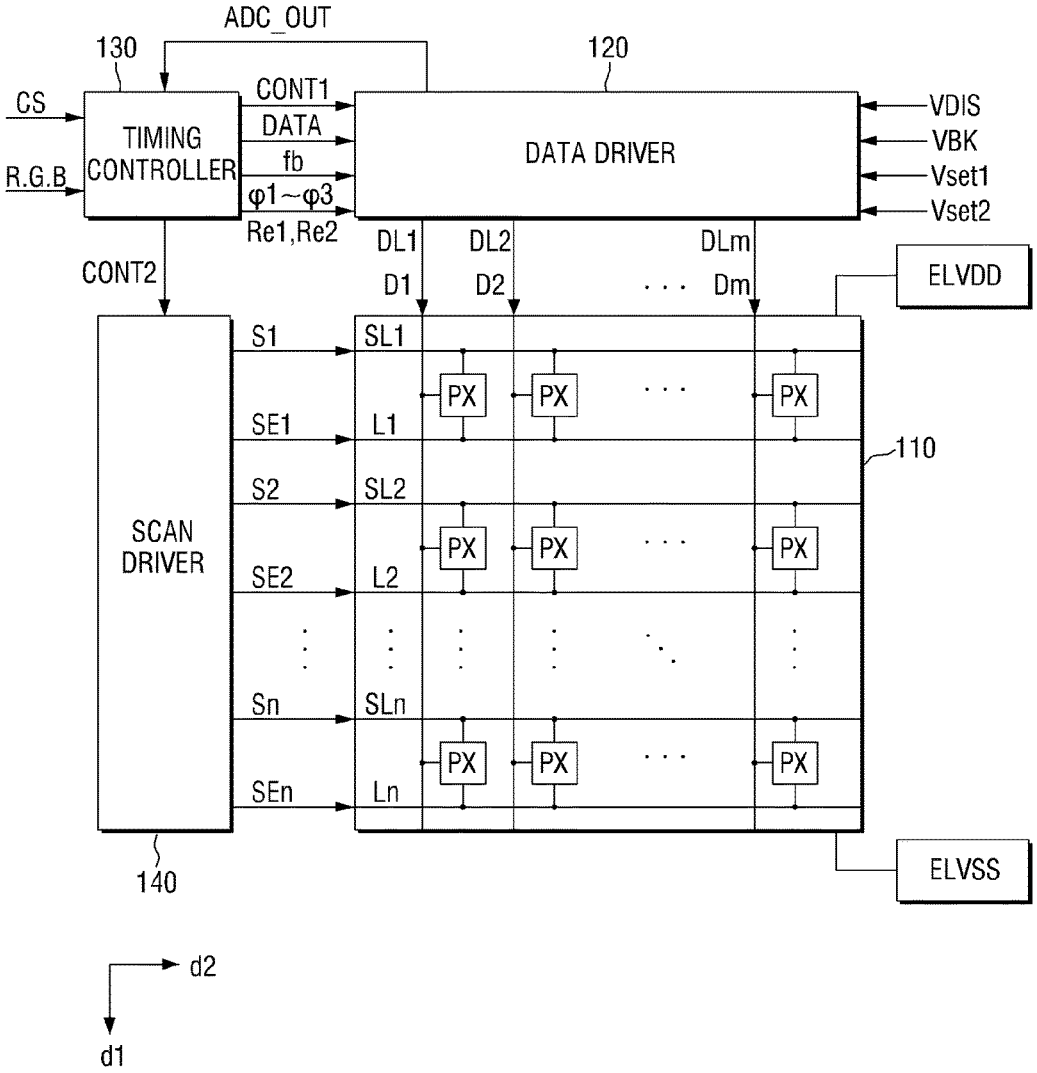
FIG. 1 is a block diagram illustrating an organic light-emitting display device according to an exemplary embodiment of the invention.

Aspects and features of the present invention and methods of accomplishing the same may be understood more readily by reference to the following detailed description of example embodiments and the accompanying drawings. The present invention may, however, be embodied in various different forms and should not be construed as being limited to the embodiments set forth herein. Rather, these embodiments are provided so that this disclosure will be thorough and complete and will fully convey the spirit and scope of the invention to those skilled in the art, and the present invention will only be defined by the appended claims, and their equivalents. Like reference numerals refer to like elements throughout the specification.

The terminology used herein is for the purpose of describing particular embodiments only and is not intended to be limiting of the invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

It will be understood that when an element or layer is referred to as being "on", "connected to" or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present. As used herein, the term "and/or" includes any and all combinations of one or more of the associated listed items. Expressions such as "at least one of," when preceding a list of elements, modify the entire list of elements and do not modify the individual elements of the list.

It will be understood that, although the terms first, second, etc. may be used herein to describe various elements, components, regions, layers and/or sections, these elements, components, regions, layers and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include variations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device, and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification, and should not be interpreted in an idealized or overly formal sense unless expressly so defined herein.

Hereinafter, example embodiments of the present invention will be described with reference to the accompanying drawings.

FIG. 1 is a block diagram illustrating an organic light-emitting display device according to an exemplary embodiment of the invention.

Referring to FIG. 1, an organic light-emitting display device according to an exemplary embodiment of the invention may include a display panel 110, a data driver 120, a timing controller 130, a scan driver 140, and a power supply.

The display panel 110 may be a region where an image is displayed. The display panel 110 may include the data lines DL1 through DLm (where m is a natural number greater than 1), a plurality of scan lines SL1 through SLn (where n is a natural number greater than 1) crossing the data lines DL1 through DLm, and a plurality of sensing lines L1 through Ln (where n is a natural number greater than 1). The display panel 110 may also include a pixel unit 120A, which include the plurality of pixels PX that are provided at the crossing regions between the data lines DL1 through DLm and the scan lines SL1 through SLn. The data lines DL1 through DLm, the scan lines SL1 through SLn, the sensing lines L1 through Ln, and the plurality of pixels PX may be disposed on a single substrate. The data lines DL1 through DLm, the scan lines SL1 through SLn, and the sensing lines L1 through Ln may be insulated from one another. The data lines DL1 through DLm may extend in a first direction d1, and the scan lines SL1 through SLn and the sensing lines L1 through Ln may extend in a second direction d2 crossing the first direction d1. In the exemplary embodiment of FIG. 1, the first direction d1 may be a column direction, and the second direction d2 may be a row direction.

The plurality of pixels PX may be arranged in a matrix form. Each of the plurality of pixels PX may be connected to one of the data lines DL1 through DLm, one of the scan lines SL1 through SLn, and one of the sensing lines L1 through Ln. The plurality of pixels PX may be provided with a plurality of scan signals S1 through Sn via the scan lines SL1 through SLn, and may be provided with a plurality of data signals D1 through Dm via the data lines DL1 through DLm connected thereto. The plurality of pixels PX may be provided with a plurality of sensing signals SE1 through SEn by the scan driver 140 via the sensing lines L1 through Ln. The plurality of pixels PX may be connected to a first power source ELVDD via a first power line, and may be connected to a second power source ELVSS via a second power line. Each of the plurality of pixels PX may control the amount of current flowing from the first power source ELVDD to the second power source ELVSS according to the data signal provided thereto via one of the data lines DL1 through DLm connected thereto.

The data driver 120 may be connected to the display panel 110 via the data lines DL1 through DLm. The data driver 120 may provide the data signals D1 through Dm to the display panel 110 via the data lines DL1 through DLm under the control of the timing controller 130. For example, the data driver 120 may provide one of the data signals D1 through Dm to one or more pixels PX selected by one of the scan signals S1 through Sn. Each of the plurality of pixels PX may be turned on by a low-level scan signal, and may emit light according to a data signal provided thereto by the data driver 120, thereby displaying an image. The data driver 120 may include a plurality of current measurement units (e.g., a plurality of current measurers), a data processing unit (e.g., a data processor), and a data driving unit (e.g., a data driving circuit), which will be described later in detail with reference to FIG. 3.

The timing controller 130 may receive a control signal CS and an image signal "R, G, B" from an external system. The control signal CS may include a vertical synchronization signal Vsync and a horizontal synchronization signal Hsync. The image signal "R, G, B" may include luminance information relating to the plurality of pixels PX. Luminance may have 1024, 256, or 64 gray levels (e.g., gray level values). The timing controller 130 may generate the image data DATA by dividing the image signal "R, G, B" in units of frames according to the vertical synchronization signal Vsync, and dividing the image signal "R, G, B" in units of the scan lines SL1 through SLn according to the horizontal synchronization signal Hsync. The timing controller 130 may provide control signals CONT1 and CONT2 to the data driver 120 and the scan driver 140, respectively, based on the control signal CS and the image signal "R, G, B". The timing controller 130 may provide the image data DATA to the data driver 120 together with the control signal CONT1, and the data driver 120 may convert the image data DATA into an analog voltage through sampling and holding according to the control signal provided thereto by the timing controller 130, thereby generating the data signals D1 through Dm. The data driver 120 may provide the data signals D1 through Dm to the plurality of pixels PX via the data lines DL1 through DLm. The timing controller 130 may provide a sensing mode switching signal EN, a feedback control signal fb for controlling the switching operation of a feedback switch, first through third control signals $\phi$1 through $\phi$3 for controlling the switching operations of first through third switches, respectively, and first and second initialization control signals Re1 and Re2 for controlling the switching operations of first and second initialization switches, respectively, to the data driver 120, which will be described later in detail with reference to FIGS. 4 and 5.

The scan driver 140 may be connected to the display panel 110 via the scan lines SL1 through SLn and the sensing lines L1 through Ln. The scan driver 140 may sequentially apply the scan signals S1 through Sn to the scan lines SL1 through SLn, respectively, according to the control signal CONT2, which is provided by the timing controller 130. The scan driver 140 may provide the sensing signals SE1 through SEn to the plurality of pixels PX (e.g., those pixels that are to be measured for the amount of current flowing therein during a sensing period) via the sensing lines L1 through Ln. The first data line DL1 and the first sensing line L1 may be connected to the same column of pixels. The scan lines SL1 through SLn and the sensing lines L1 through Ln may provide signals for turning on different transistors in each of the plurality of pixels. In the exemplary embodiment of FIG. 1, the scan driver 140 may provide the sensing signals SE1 through SEn to the plurality of pixels PX, but the invention is not limited thereto. For example, an additional integrated circuit (IC) may be provided to provide the sensing signals SE1 through SEn to the plurality of pixels PX via the sensing lines L1 through Ln. For this case, the scan driver 140 may include a scan signal providing unit (e.g., a scan signal provider), which is connected to the gate electrodes of the switching transistors of the plurality of pixels PX via the scan lines SL1 through SLn, and a sensing signal providing unit (e.g., a sensing signal provider), which is connected to the gate electrodes of the sensing transistors of the plurality of pixels PX via the sensing lines L1 through Ln. One of the scan signal providing unit and the sensing signal providing unit may be selected by a switching operation, and the timing controller 130 may control the switching operation according to the control signal CONT2.

The power supply may supply a driving voltage to the plurality of pixels PX according to control signals provided by the timing controller 130. A voltage provided by the first power source ELVDD may be of a high level, and a voltage provided by the second source ELVSS may be of a low level. The first power source ELVDD and the second power source ELVSS may provide a driving voltage for driving the plurality of pixels PX. For convenience, both the first power source and the voltage provided by the first power source will hereinafter be referred to as ELVDD, and both the second power source and the voltage provided by the second power source will hereinafter be referred to as ELVSS. The power supply may provide a first reference voltage Vset1 and a second reference voltage Vset2 to the data driver 120, and may also provide a first initialization voltage VDIS and a second initialization voltage VBK to the data driver 120. The first and second reference voltages Vset1 and Vset2, which are provided by the power supply, may be provided to the non-inverted input terminals of first and second operational amplifiers, respectively. The first and second initialization voltages VDIS and VBK may be provided to the data lines DL1 through DLm by switching operations performed by the first and second initialization switches.

Figure 2:
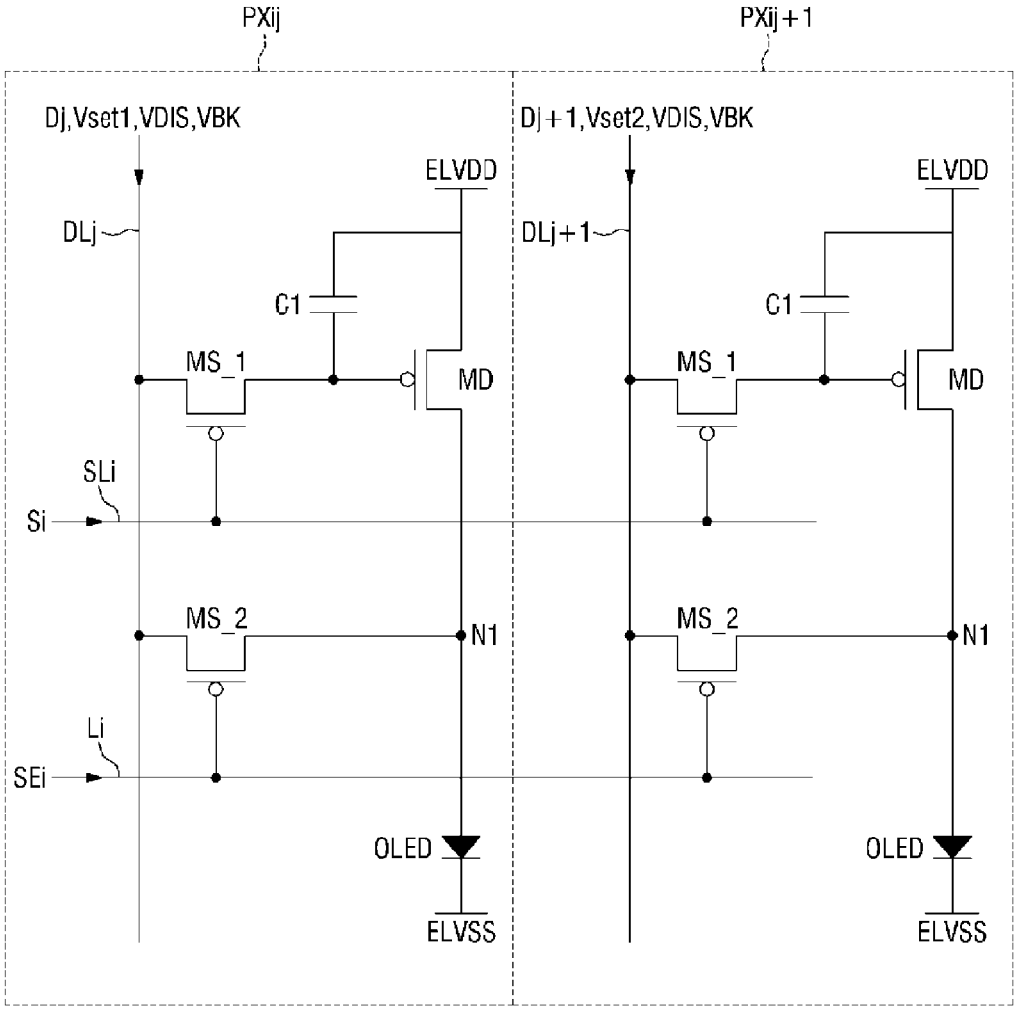
FIG. 2 is a circuit diagram of pixels according to an exemplary embodiment of the invention.

FIG. 2 is a circuit diagram illustrating pixels according to an exemplary embodiment of the invention. FIG. 2 illustrates a pixel PXij connected to an i-th scan line SLi, an i-th sensing line Li, and a j-th data line DLj, and a pixel PXij+1 connected to the i-th scan line SLi, the i-th sensing line Li, and a (j+1)-th data line DLj+1, as examples of the plurality of pixels PX of FIG. 1. For convenience, the pixel PXij and the pixel PXij+1 will hereinafter be referred to as a first pixel and a second pixel, respectively.

Referring to FIG. 2, each of the first and second pixels PXij and PXij+1 may include a switching transistor MS_1, a sensing transistor MS_2, a driving transistor MD, a first capacitor C1, and an organic light-emitting diode ("OLED") OLED.

Referring to the first pixel PXij, the switching transistor MS_1 may include a gate electrode, which is connected to the i-th scan line SLi and receives an i-th scan signal Si from the i-th scan line SLi, a first electrode, which is connected to the j-th data line DLj and receives a j-th data signal Dj from the j-th data line DLj, and a second electrode, which is connected to a first terminal of the first capacitor C1. The switching transistor MS_1 may be turned on by the i-th scan signal provided to the gate electrode thereof via the i-th scan line SLi, and may transmit the j-th data voltage Dj provided thereto via the j-th data line DLj to the first capacitor C1. The driving transistor MD may include a first electrode, which is connected to the first power source ELVDD, a second electrode, which is connected to a first node N1, and a gate electrode, which is connected to the second electrode of the switching transistor MS_1. The driving transistor MD may control a driving current applied from the first power source ELVDD to the OLED according to a voltage corresponding to the j-th data signal Dj, which is applied to the gate electrode of the driving transistor MD. The sensing transistor MS_2 may include a first electrode, which is connected to the j-th data line DLj, a second electrode, which is connected to the first node N1, and a gate electrode, which is connected to the i-th sensing line Li. The sensing transistor MS_2 may be turned on by an i-th sensing signal SEi provided thereto via the i-th sensing line Li. The sensing transistor MS_2 may measure information regarding the driving properties of the driving transistor MD, for example, a driving current. During a sensing period, the sensing transistor MS_2 may measure, and read out, a current flowing in the OLED via the i-th scan line SLi. The OLED may include an anode electrode, which is connected to the first node N1, a cathode electrode, which is connected to the second power source ELVSS, and an organic light-emitting layer. The organic light-emitting layer may emit light of one of a plurality of primary colors, and the plurality of primary colors may include red, green, and blue. A desired color may be displayed by a spatial or temporal sum of the primary colors. The organic light-emitting layer may include a low- or high-molecular organic material corresponding to each color. The organic material included in the organic light-emitting layer may emit light corresponding to each color according to the amount of current flowing in the organic light-emitting layer. The first capacitor C1 may include the first terminal, which is connected to the second electrode of the switching transistor MS_1, and a second terminal, which is connected to the first electrode of the driving transistor MD. The first capacitor C1 may receive the j-th data signal Dj, which is provided via the j-th data line DLj, through a switching operation performed by the switching transistor MS_1. For example, the switching transistor MS_1, the driving transistor MD, and the sensing transistor MS_2 may be p-type transistors.

The second pixel PXij+1 has the same or substantially the same structure as the first pixel PXij, except the first electrodes of the switching transistor MS_1 and the sensing transistor MS_2 are connected to the (j+1)-th data line DLj+1, and thus, are provided with a (j+1)-th data signal Dj+1. The first pixel PXij may be provided with the first reference voltage Vset1, the first initialization voltage VDIS, and the second initialization voltage VBK via the j-th data line DLj, and the second pixel PXij+1 may be provided with the second reference voltage Vset2, the first initialization voltage VDIS, and the second initialization voltage VBK via the (j+1)-th data line DLj+1, which will be described later in detail with reference to FIG. 5.

Figure 3:
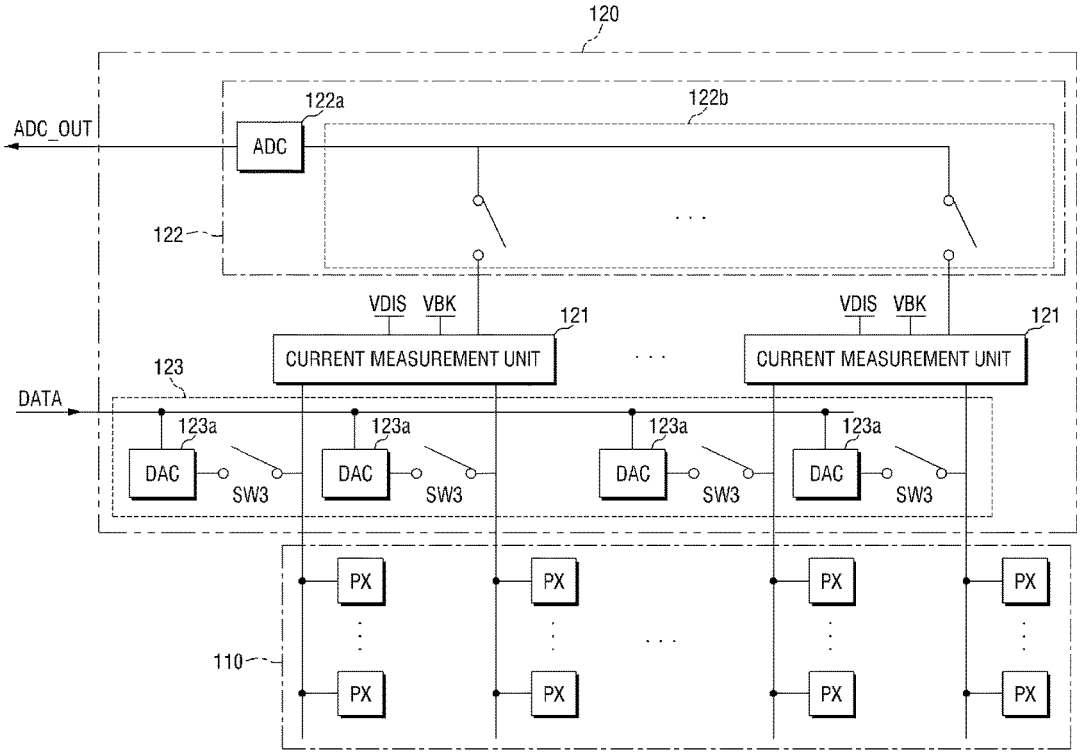
FIG. 3 is a block diagram illustrating a data driver of the organic light-emitting display device of FIG. 1.

FIG. 3 is a block diagram of the data driver 120 of the organic light-emitting display device of FIG. 1.

Referring to FIG. 3, the data driver 120 may include a plurality of current measurement units 121 (e.g., a plurality of current measurers), a data processing unit 122 (e.g., a data processor), and a data driving unit 123 (e.g., a data driving circuit).

The current measurement units 121 may be connected to the plurality of pixels PX via the data lines DL1 through DLj. Each of the current measurement units 121 may be connected to two of the data lines from among the data lines DL1 through DLj. In the exemplary embodiment of FIG. 3, each of the current measurement units 121 may be connected to two of the data lines from among the data lines DL1 through DLj, but the invention is not limited thereto. That is, each of the current measurement units 121 may be connected to at least 2n data lines (where n is a natural number greater than 1) via a multiplexer. Each of the current measurement units 121 may serve as a current integrator during a sensing period, and may serve as an output buffer during a display period. The sensing period may be a period for measuring a current from each OLED, and determining a compensation value based on the results of the measurement. The display period may be a period for correcting the image data DATA based on the compensation value, and outputting the corrected image data to the display panel 110. Each of the current measurement units 121 may be provided with the first and second initialization voltages VDIS and VBK by the power supply. The current measurement units 121 will be described in further detail with reference to FIG. 4.

The data processing unit 122 may include an analog-to-digital converter ("ADC") 122*a* and a multiplexer 122*b*. The multiplexer 122*b* may be connected between the output terminals of the current measurement units 121 and the ADC 122*a*. The multiplexer 122*b* may provide output signals of the current measurement units 121 to the ADC 122*a* through a switching operation. In order for the multiplexer 122*b* to perform a switching operation, the data processing unit 122 may also include a shift register. Accordingly, the multiplexer 122*b* may provide the output signals of the current measurement units 121 to the ADC 122*a* under the control of the shift register. The ADC 122*a* may convert the output signals of the current measurement units 121 into digital signals ADC_OUT, and may provide the digital signals ADC_OUT to the timing controller 130. The ADC 122*a* may be implemented as a pipeline-, a successive approximation register (SAR)-, or a single slope-type ADC.

The data driving unit 123 may be connected to each of the data lines DL1 through DLm. The data driving unit 123 may convert the image data provided by the timing controller 130 into analog data signals D1 through Dm, and may provide the analog data signals D1 through Dm to the data lines DL1 through DLm. For this, the data driving unit 123 may include a plurality of digital-to-analog converters (DACs) 123*a* and a plurality of third switches SW_3, which are connected between the DACs 123*a* and the data lines DL1 through DLm, respectively. For example, the third switches SW_3 may be n-type switches. The DACs 123*a* may convert the image data DATA, which is digital data provided by the timing controller 130, into the analog data signals D1 through Dm. The third switches SW_3 may receive the third control signal ϕ3 from the timing controller 130, and may perform a switching operation according to the third control signal ϕ3. During the display period, the third switches SW_3 may be turned on by the third control signal ϕ3 and may thus connect signal paths between the DACs 123*a* and the data lines DL1 through DLm, respectively.

Figure 4:
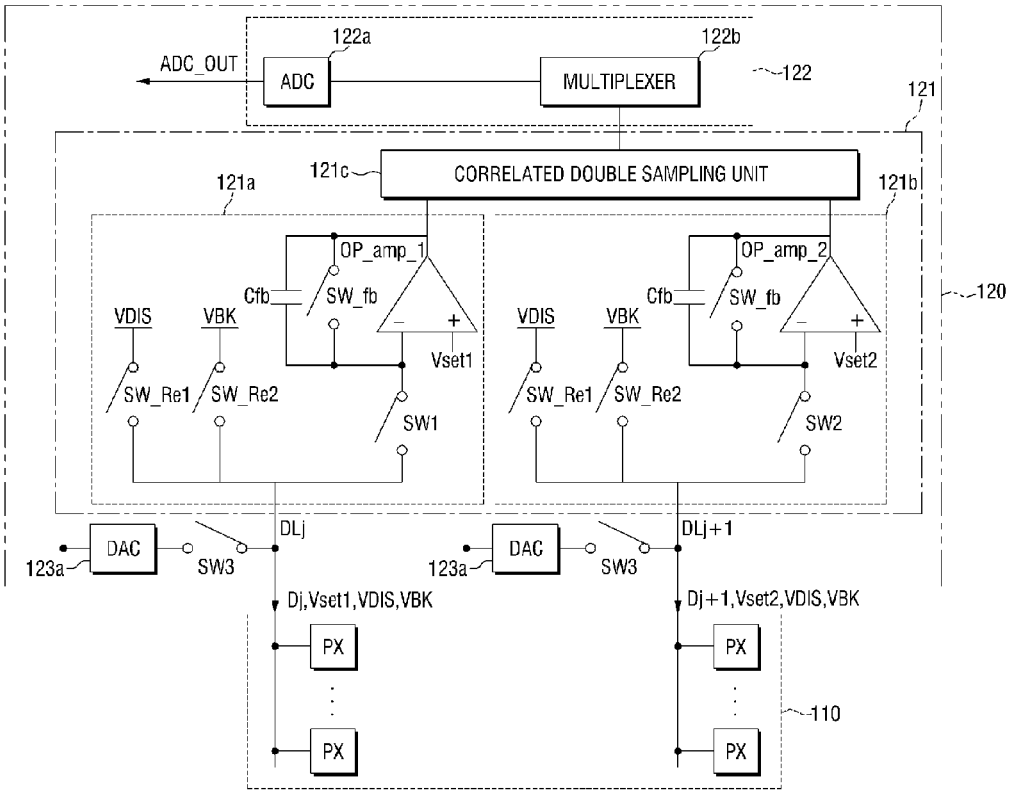
FIG. 4 is a circuit diagram illustrating a current measurement unit of the data driver of FIG. 3.

FIG. 4 is a circuit diagram illustrating a current measurement unit 121 of the data driver 120 of FIG. 3.

Referring to FIG. 4, the current measurement unit 121 may include a first measurement circuit 121*a*, a second measurement circuit 121*b*, and a correlated double sampling unit 121*c* (e.g., a correlated double sampler). In the exemplary embodiment of FIG. 4, the first measurement circuit 121*a* may be connected to the j-th data line DLj, and the second measurement circuit 121*b* may be connected to the (j+1)-th data line DLj+1. However, the invention is not limited to the exemplary embodiment of FIG. 4. That is, the current measurement unit 121 may be connected to at least 2n data lines (where n is a natural number greater than 1) among the data lines DL1 through DLm via a multiplexer. The first measurement circuit 121*a* may be connected to a pixel, among other pixels connected to the j-th data line DLj, that may be measured for a current flowing therein, and the second measurement circuit 121*b* may be connected to a pixel, among other pixels connected to the (j+1)-th data line DLj+1, that may be measured for a current flowing therein.

The first measurement circuit 121*a* may include a first operational amplifier OP-amp_1, a first feedback capacitor Cfb, a first feedback switch SW_fb, a first switch SW1, a first initialization switch SW_Re1, and a second initialization switch SW_Re2. For example, the first feedback switch SW_fb, the first initialization switch SW_Re1, and the second initialization switch SW_Re2 may be n-type switches. The first operational amplifier OP-amp_1 may include an inverted input terminal (−), a non-inverted input terminal (+), and an output terminal. The first reference voltage Vset1 may be applied to the non-inverted input terminal (+) of the first operational amplifier OP-amp_1 by the power supply. For a read-out of a signal and noise by the first measurement circuit 121*a*, the first reference voltage Vset1 may be a voltage corresponding to both a signal and noise. For example, the first reference voltage Vset1 may be greater than a threshold voltage Vth of each OLED. The first switch SW1 may be connected between the inverted input terminal (−) of the first operational amplifier OP-amp_1 and the j-th data line DLj. The first switch SW1 may be provided with the first control signal ϕ1, and may perform a switching operation according to the first control signal ϕ1. The first feedback capacitor Cfb may have a first terminal connected to the inverted input terminal (−) of the first operational amplifier OP-amp_1, and a second terminal connected to the output terminal of the first operational amplifier OP-amp_1. The first feedback switch SW_fb and the first feedback capacitor Cfb may be connected in parallel between the inverted input terminal (−) of the first operational amplifier OP-amp_1 and the output terminal of the first operational amplifier OP-amp_1. The first feedback switch SW_fb may be provided with the feedback control signal fb by the timing controller 130, and may perform a switching operation according to the feedback control signal fb. The first initialization switch SW_Re1 may be connected between the power supply and the j-th data line DLj. The first initialization switch SW_Re1 may be provided with the first initialization control signal Re1 by the timing controller 130, and may perform a switching operation according to the first initialization control signal Re1. The second initialization switch SW_Re2 may be connected between the power supply and the j-th data line DLj. The second initialization switch SW_Re2 may be provided with the second initialization control signal Re2 by the timing controller 130, and may perform a switching operation according to the second initialization control signal Re2.

The second measurement circuit 121*b* may include a second operational amplifier OP-amp_2, a second feedback capacitor Cfb, a second feedback switch SW_fb, a second switch SW2, a first initialization switch SW_Re1, and a second initialization switch SW_Re2. The second operational amplifier OP-amp_2 may include an inverted input terminal (−), a non-inverted input terminal (+), and an output terminal. The second reference voltage Vset2 may be applied to the non-inverted input terminal (+) of the second operational amplifier OP-amp_1 by the power supply. For a read-out of a signal and noise by the second measurement circuit 121*b*, the second reference voltage Vset2 may be a voltage corresponding to noise. For example, the second reference voltage Vset2 may be greater than the threshold voltage Vth of each OLED. The rest of the structure of the second measurement circuit 121*b* is almost identical to or substantially the same as that of the first measurement circuit 121*a*, and thus, a detailed description thereof will be omitted.

The correlated double sampling unit 121*c* may be connected between the output terminals of the first and second measurement circuits 121*a* and 121*b* and the data processing unit. For example, the correlated double sampling unit 121*c* may be connected between the multiplexer 122*b* and the output terminals of the first and second operational amplifiers OP-amp_1 and OP-amp_2. The correlated double sampling unit 121*c* may perform correlated double sampling (CDS) on output signals of the first and second operational amplifiers OP-amp_1 and OP-amp_2 under the control of the timing controller 130. The correlated double sampling unit 121*c* may detect a difference between the electric potentials of the output signals of the first and second operational amplifiers OP-amp_1 and OP-amp_2, and may provide the results of the detection to the ADC 122*a*. The correlated double sampling unit 112*c* may maintain a desirable signal-to-noise ratio (SNR) by performing CDS on the output signals of the first and second operational amplifiers OP-amp_1 and OP-amp_2.

Figure 5:
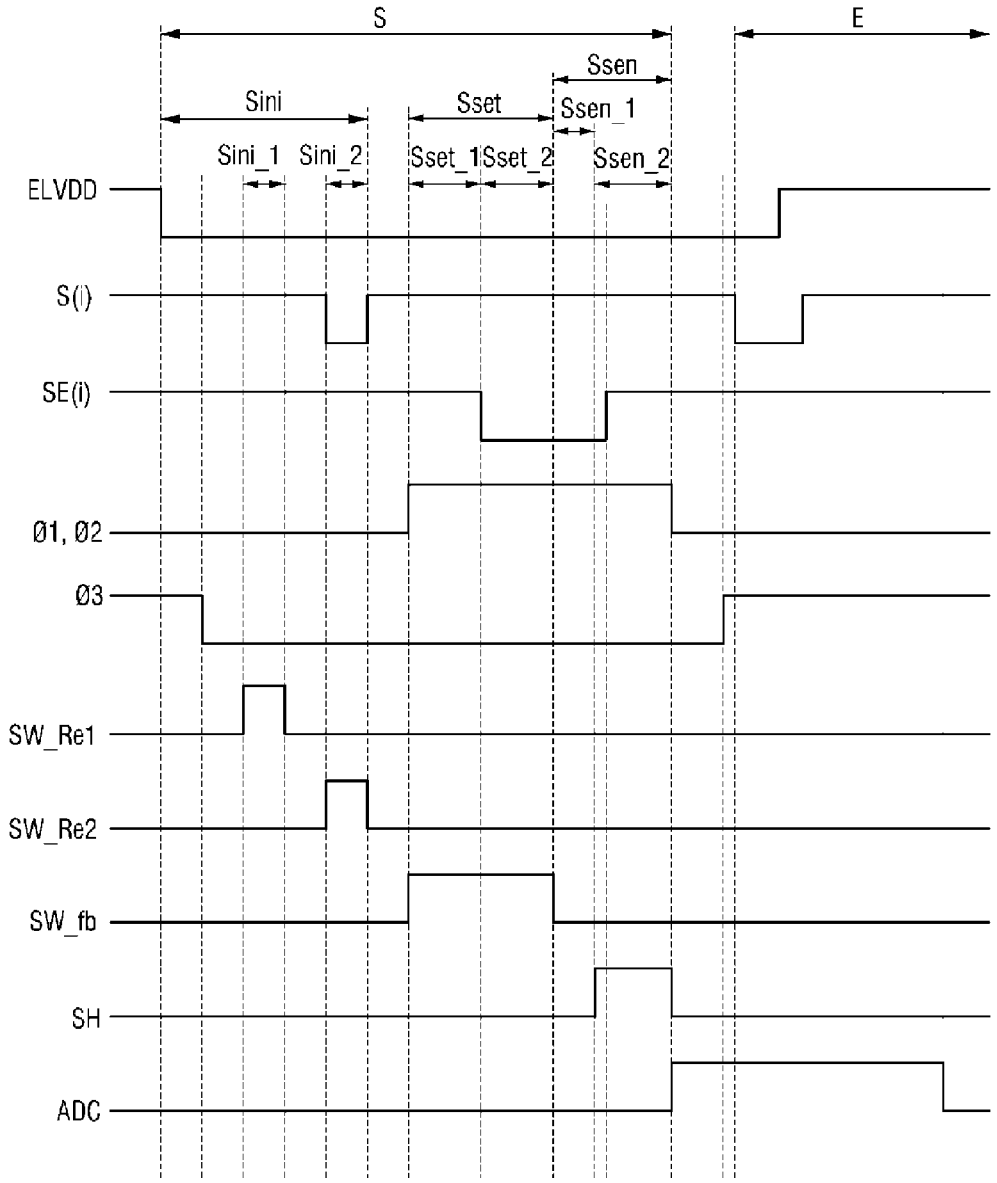
FIG. 5 is a timing diagram illustrating the driving of the organic light-emitting display device of FIG. 1.
Figure 6:
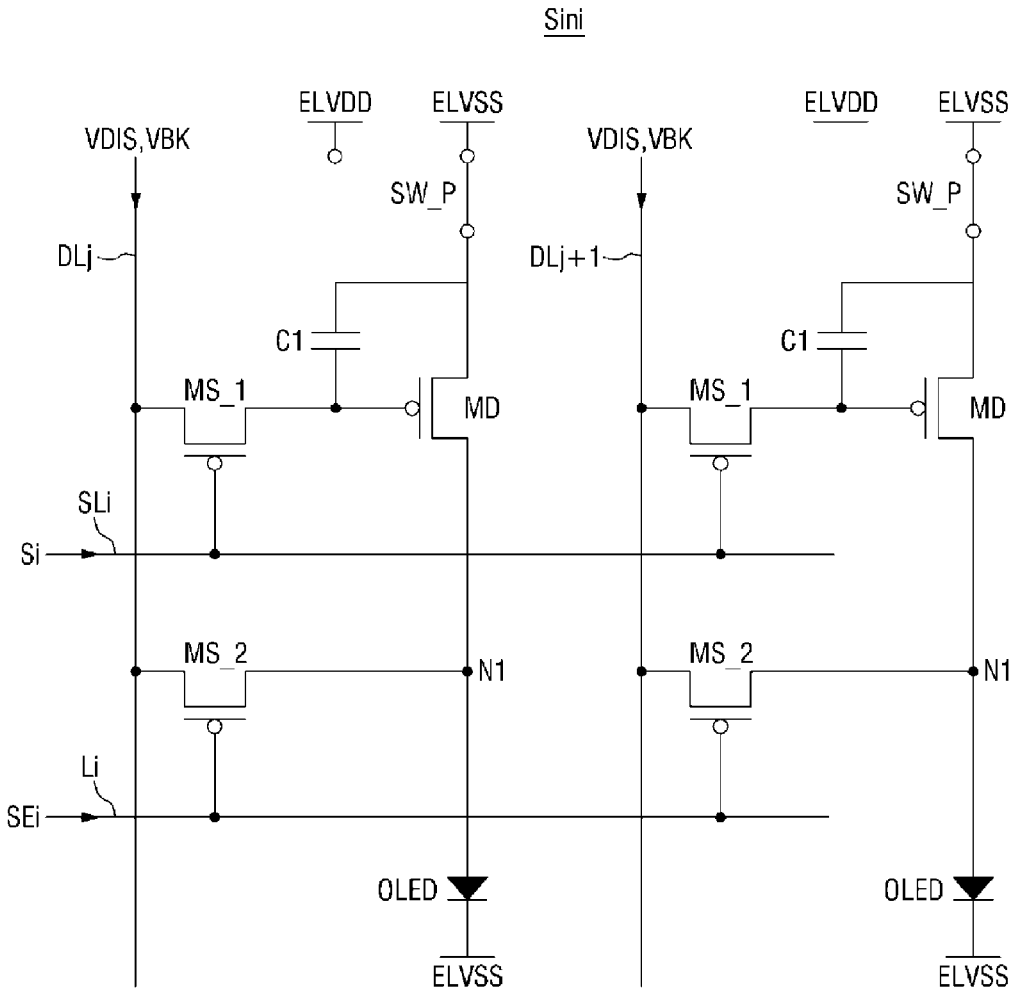
FIG. 6 is a circuit diagram illustrating an operating state of the organic light-emitting display device of FIG. 1 during an initialization period.
Figure 7:
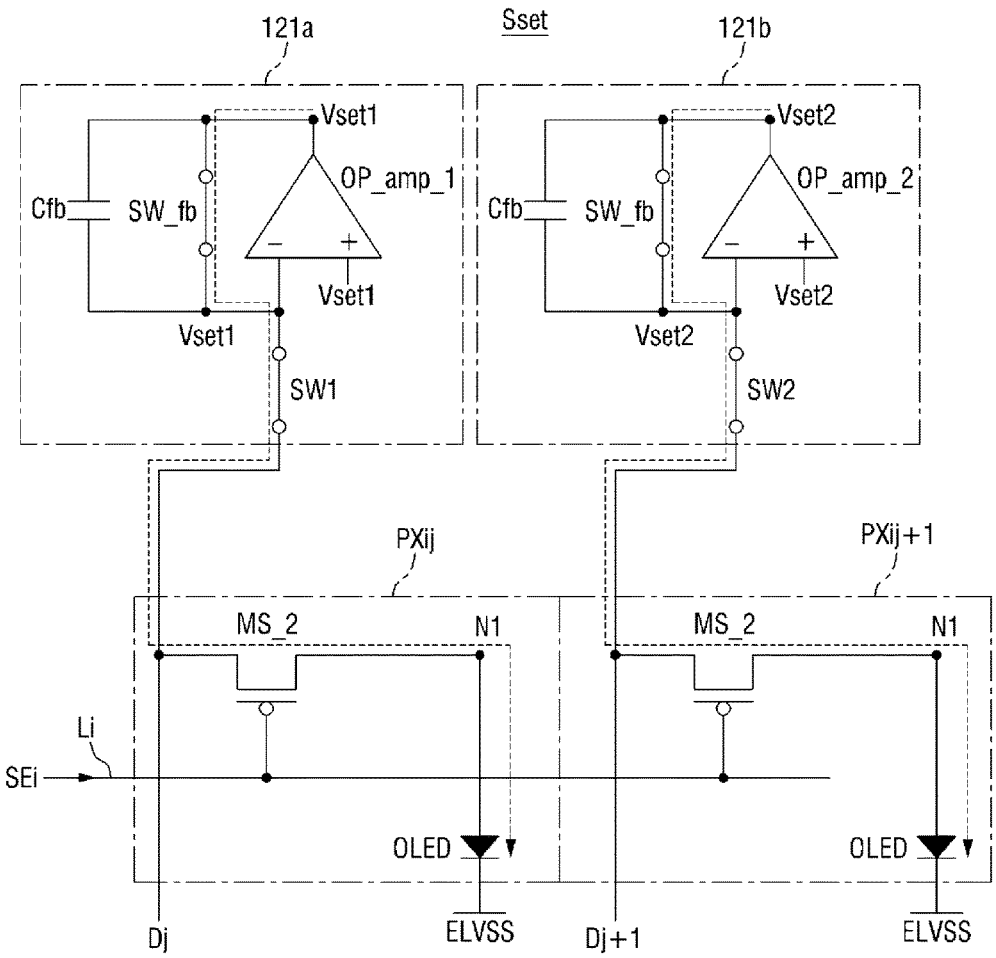
FIG. 7 is a circuit diagram illustrating an operating state of the organic light-emitting display device of FIG. 1 during a reference voltage supply period.
Figure 8:
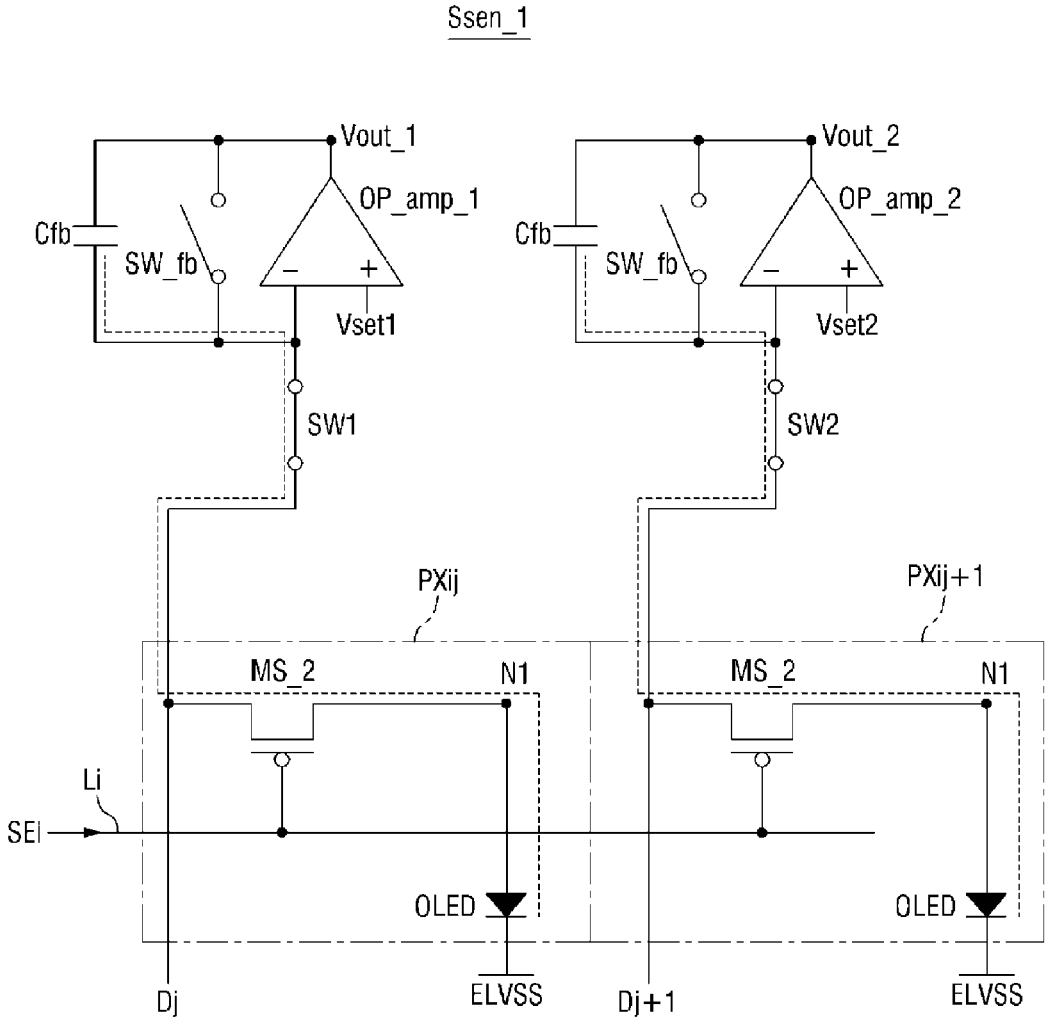
FIG. 8 is a circuit diagram illustrating an operating state of the organic light-emitting display device of FIG. 1 during a measurement period.

FIG. 5 is a timing diagram illustrating the driving of the organic light-emitting display device of FIG. 1. FIG. 6 is a circuit diagram illustrating an operating state of the organic light-emitting display device of FIG. 1 during an initialization period. FIG. 7 is a circuit diagram illustrating an operating state of the organic light-emitting display device of FIG. 1 during a reference voltage supply period. FIG. 8 is a circuit diagram illustrating an operating state of the organic light-emitting display device of FIG. 1 during a measurement period. A driving of the organic light-emitting display device of FIG. 1 will hereinafter be described with reference to FIGS. 5 to 8, taking as an example a series of operations performed in, and between, the first and second pixels PXij and PXij+1 and the current measurement unit 121 that measures a current from each of the first and second pixels PXij and PXij+1.

Referring to FIG. 5, the operation of the organic light-emitting display device according to an exemplary embodiment of the invention may be divided into a sensing period S and a display period E. The sensing period S may be a period for sensing a current flowing in each OLED to calculate the current-voltage characteristics of each OLED. The sensing period S may be activated in response to the whole organic light-emitting display device being turned off or on. The sensing period S may be activated during a standby time when the organic light-emitting display device is being turned on or off, but the invention is not limited thereto. That is, the sensing period S may be activated at regular intervals of time or according to a user setting. The sensing period S may be divided into an initialization period Sini, a reference voltage supply period Sset, and a measurement period Ssen. The initialization period Sini may include a first initialization period Sini_1 for charging all the data lines DL1 through DLm, which are each charged with a voltage (e.g., an arbitrary voltage) due to a coupling, with the first initialization voltage VDIS, and a second initialization period Sini_2 for charging the first capacitor C1 with the second initialization voltage VBK to interrupt a leakage current that flows into the first power source ELVDD during a current measurement operation. The order between the first initialization period Sini_1 and the second initialization period Sini_2 within the sensing period S may be varied. The reference voltage supply period Sset may be a period for applying the first or second reference voltages Vset1 or Vset2 to the anode electrodes of the OLEDs of the first and second pixels PXij and PXij+1. The measurement period Ssen may be a period for measuring a current flowing in each of the OLEDs of the first and second pixels PXij and PXij+1 in response to the application of the first or second reference voltages Vset1 or Vset2 to the anode electrodes of the OLEDs of the first and second pixels PXij and PXij+1.

The operation of the organic light-emitting display device according to an exemplary embodiment of the invention during the initialization period Sini of the sensing period S will hereinafter be described with reference to FIGS. 5 and 6. The voltage level of the first power source ELVDD may be reduced to the voltage level of the second power source ELVSS. For this, each of the first and second pixels PXij and PXij+1 may include a power switch SW_P. In each of the first and second pixels PXij and PXij+1, the power switch SW_P may be connected between the first electrode of the driving transistor MD and the first or second power source ELVDD or ELVSS, and thus, may perform a switching operation under the control of the timing controller 130. For example, during the sensing period S, a signal path between the first electrode of the driving transistors MD of the first and second pixels PXij and PXij+1 and the second power source ELVSS may be connected via a switching operation performed by the power switches SW_P of the first and second pixels PXij and PXij+1. In this exemplary embodiment, the voltage level of the first power source ELVDD may be reduced to the voltage level of the second power source ELVSS, but the invention is not limited thereto. That is, the voltage level of the second power source ELVSS may be increased to the voltage level of the first power source ELVDD. Thereafter, in response to a low-level third control signal ϕ3 being generated, the third switches SW3 in the data driving unit 123 may be turned off. As a result, the provision of the data signals D1 through Dm via the data lines DL1 through DLm, respectively, may be blocked.

During the first initialization period Sini_1, a high-level first initialization control signal Re1 may be generated, and as a result, the first initialization switches SW_Re1 in the current measurement unit 121 may be turned on. The i-th scan signal Si and the i-th sensing signal SEi may maintain their high level, and thus, may continuously turn off (e.g., keep turned off) the switching transistors MS_1 and the sensing transistors MS_2 of the first and second pixels PXij and PXij+1. The first through third control signals ϕ1 through ϕ3, the second initialization control signal Re2, and the feedback control signal fb may maintain their low level, and may thus continuously turn off the first switch SW1, the second switch SW2, the second initialization switches SW_Re2, and the first and second feedback switches SW_fb of the current measurement unit 121, and the third switches SW3 of the data driving unit 123. In a case when the voltage level of the first power source ELDVD is lowered to the voltage level of the second power source ELVSS, each of the data lines DL1 through DLm may already be charged with a voltage (e.g., an arbitrary voltage) due to a coupling. Thus, pixels adjacent to the first and second pixels PXij and PXij+1 may emit light during the measurement of a current from each of the first and second pixels PXij and PXij+1, and as a result, an image may be distorted. To prevent the adjacent pixels from undesirably emitting light, the j-th and (j+1)-th data lines DLj and DLj+1, to which the first and second pixels PXij and PXij+1 are respectively connected, as well as the other data lines, may be charged with the first initialization voltage VDIS. During the first initialization period Sini_1, the first initialization voltage VDIS may be lower than the threshold voltage Vth of the OLEDs of the first and second pixels PXij and PXij+1.

During the second initialization period Sini_2, a high-level second initialization control signal Re2 may be generated, and as a result, the second initialization switches SW_Re2 in the current measurement unit 121 may be turned on. The i-th scan signal Si and the i-th sensing signal SEi may be inverted to its low level, and thus, may turn on the switching transistors MS_1 of the first and second pixels PXij and PXij+1. The i-th sensing signal SEi may maintain its high level, and may thus continuously turn off the sensing transistors MS_2 of the first and second pixels PXij and PXij+1. The first through third control signals ϕ1 through ϕ3, the first initialization control signal Re1, and the feedback control signal fb may maintain their low level, and may thus continuously turn off the first switch SW1, the second switch SW2, the first initialization switches SW_Re2, and the first and second feedback switches SW_fb of the current measurement unit 121, and the third switches SW3 of the data driving unit 123. Accordingly, during the second initialization period Sini_2, the second initialization switches SW_Re2 of the current measurement unit 121 and the switching transistors MS_1 of the first and second pixels PXij and PXij+1 may be turned on, and as a result, the first capacitors C1 of the first and second pixels PXij and PXij+1 may be charged with the second initialization voltage VBK. Therefore, the generation of a leakage current that flows into the first power source ELVDD during a current measurement operation may be prevented or reduced. During the second initialization period Sini_2, the second initialization voltage VBK may be greater than the first and second voltages Vset1 and Vset2.

In this exemplary embodiment, the first initialization voltage VDIS and then the second initialization voltage VBK may be applied to each of the first and second pixels PXij and PXij+1, but the invention is not limited thereto. That is, the second initialization voltage VBK and then the first initialization voltage VDIS may be applied to each of the first and second pixels PXij and PXij+1.

The operation of the organic light-emitting display device according to an exemplary embodiment of the invention during the sensing period will hereinafter be described with reference to FIGS. 5 and 7. In the description that follows, it is assumed that the first and second measurement circuits 121*a* and 121*b* of the current measurement unit 121 are connected to the first and second pixels PXij and PXij+1 via the j-th and (j+1)-th data lines DLj and DLj+1, respectively.

The reference voltage supply period Sset may include a first reference voltage supply period Sset_1 for turning on the first and second feedback switches SW_fb in response to the feedback control signal fb being inverted to its high level, and a second reference voltage supply period Sset_2 for turning off the first and second feedback switches SW_fb in response to the feedback control signal fb being inverted back to its low level.

During the first reference voltage supply period Sset_1, the feedback control signal fb may be inverted to its high level, and may thus turn on the first and second feedback switches SW_fb. The first and second control signals ϕ1 and ϕ2 may be inverted to their high level, and may thus turn on the first switch SW1 and the second switch SW2 of the current measurement unit 121. The feedback control signal fb may be inverted to its high level, and may thus turn on the first and second feedback switches SW_fb. The i-th scan signal Si may be inverted to its high level, and may thus turn on the switching transistors MS_1 of the first and second pixels PXij and PXij+1. The i-th sensing signal SEi may maintain its high level, and may thus continuously turn off the sensing transistors MS_2 of the first and second pixels PXij and PXij+1. The third control signal ϕ3 and the first and second initialization control signals Re1 and Re2 may maintain their low level, and may thus continuously turn off the third switches SW3 of the data driving unit 123 and the first initialization switches SW_Re1 and the second initialization switches SW_Re2 of the current measurement unit 121.

In the case of the first pixel PXij, the non-inverted input terminal (+) of the first operational amplifier OP-amp_1 of the first measurement circuit 121*a* may be provided with the first reference voltage Vset1. The inverted input terminal (−) and the output terminal of the first operational amplifier OP-amp_1 may be short-circuited, and the inverted input terminal (−) of the first operational amplifier OP-amp_1 may be connected to the OLED of the first pixel PXij via the sensing transistor MS_2 of the first pixel PXij. The first feedback capacitor Cfb may be reset due to the short circuit between the inverted input terminal (−) and the output terminal of the first operational amplifier OP-amp_1. The electric potential at the output terminal of the first operational amplifier OP-amp_1 may be maintained at the first reference voltage Vset1, and the electric potential at the inverted input terminal (−) of the first operational amplifier OP-amp_1 may also be maintained at the first reference voltage Vset1 due to the virtual ground properties of the first operational amplifier OP-amp_1. The first reference voltage Vset1 may charge the j-th data line DLj.

In the case of the second pixel PXij+1, the non-inverted input terminal (+) of the second operational amplifier OP-amp_2 of the second measurement circuit 121*b* may be provided with the second reference voltage Vset2. The inverted input terminal (−) and the output terminal of the second operational amplifier OP-amp_2 may be short-circuited, and the inverted input terminal (−) of the second operational amplifier OP-amp_2 may be connected to the OLED of the second pixel PXij+1 via the sensing transistor MS_2 of the second pixel PXij+1. The second feedback capacitor Cfb may be reset due to the short circuit between the inverted input terminal (−) and the output terminal of the second operational amplifier OP-amp_2. The electric potential at the output terminal of the second operational amplifier OP-amp_2 may be maintained at the second reference voltage Vset2, and the electric potential at the inverted input terminal (−) of the second operational amplifier OP-amp_2 may also be maintained at the second reference voltage Vset2 due to the virtual ground properties of the second operational amplifier OP-amp_2. The second reference voltage Vset2 may charge the (j+1)-th data line DLj+1.

Thereafter, during the second reference voltage supply period Sset_2, the feedback control signal fb may be inverted back to its low level and may thus turn off the first and second feedback switches SW_fb. The i-th sensing signal SEi may maintain its low level and may thus turn on the sensing transistors MS_2 of the first and second pixels PXij and PXij+1. The first and second control signals ϕ1 and ϕ2 may be inverted to their high level, and may thus turn on the first switch SW1 and the second switch SW2 of the current measurement unit 121. The i-th scan signal Si may maintain its high level and may thus continuously turn off the switching transistors MS_1 of the first and second pixels PXij and PXij+1. The third control signal ϕ3, the first initialization signal Re1, and the second initialization signal Re2 may maintain their low level, and may thus continuously turn off the third switches SW3 of the data driving unit 123 and the first initialization switches SW_Re1 and the second initialization switches SW_Re2 of the current measurement unit 121.

In the first pixel PXij, in response to the sensing transistor MS_2 being turned on, the first reference voltage Vset1 that the j-th data line DLj is charged with may be applied to the anode electrode of the OLED. Since the first reference voltage Vset1 is greater than the threshold voltage Vth of the OLED of the first pixel PXij, a current may flow in the OLED of the first pixel PXij, but the amount of current flowing in the OLED of the first pixel PXij may vary depending on the degree of the deterioration of the OLED of the first pixel PXij.

In the second pixel PXij+1, in response to the sensing transistor MS_2 being turned on, the second reference voltage Vset2 that the (j+1)-th data line DLj+1 is charged with may be applied to the anode electrode of the OLED. Since the second reference voltage Vset2 is lower than the threshold voltage Vth of the OLED of the second pixel PXij+1, no current may flow in the OLED of the second pixel PXij+1.

The operation of the organic light-emitting display device according to an exemplary embodiment of the invention during the measurement period Ssen of the sensing period S will hereinafter be described with reference to FIGS. 5 and 8. The measurement period Ssen may include a first measurement period Ssen_1, which follows the reference voltage supply period Sset, and a second measurement period Ssen_2, which follows the first measurement period Ssen_1.

During the first measurement period Ssen_1, the feedback control signal fb may be inverted to its low level, and may thus turn off the first and second feedback switches SW_fb. The first and second control signals ϕ1 and ϕ2 may maintain their high level, and may thus continuously turn on the first switch SW1 and the second switch SW2 of the current measurement unit 121. The i-th sensing signal SEi may maintain its low level, and may thus continuously turn on the sensing transistors MS_2 of the first and second pixels PXij and PXij+1. The i-th scan signal Si may maintain its high level and may thus turn off the switching transistors MS_1 of the first and second pixels PXij and PXij+1. The third control signal ϕ3, the first initialization signal Re1, and the second initialization signal Re2 may maintain their low level, and may thus continuously turn off the third switches SW3 of the data driving unit 123 and the first initialization switches SW_Re1 and the second initialization switches SW_Re2 of the current measurement unit 121.

In the case of the first pixel PXij, the short circuit between the inverted input terminal (−) and the output terminal of the first operational amplifier OP-amp_1 of the first measurement circuit 121*a* may be terminated (in other words, broken), and as a result, the first operational amplifier OP-amp_1 may operate as an integrator. The inverted input terminal (−) of the first operational amplifier OP-amp_1 may be connected to the OLED of the first pixel PXij via the first switch SW1 of the first measurement circuit 121*a*. The first feedback capacitor Cfb may be charged with the sum of a voltage corresponding to a current flowing in the OLED of the first pixel PXij and a voltage corresponding to a leakage current in the first pixel PXij. Accordingly, an electric potential Vout_1 at the first operational amplifier OP-amp_1 may linearly increase according to the sum of the voltage corresponding to the current flowing in the OLED of the first pixel PXij and the voltage corresponding to the leakage current in the first pixel PXij.

In the case of the second pixel PXij+1, the short circuit between the inverted input terminal (−) and the output terminal of the second operational amplifier OP-amp_2 of the second measurement circuit 121*b* may be terminated (in other words, broken), and as a result, the second operational amplifier OP-amp_2 may operate as an integrator. The inverted input terminal (−) of the second operational amplifier OP-amp_2 may be connected to the OLED of the second pixel PXij+1 via the second switch SW2 of the second measurement circuit 121*b*. Since no current flows in the OLED of the second pixel PXij+1, unlike in the OLED of the first pixel PXij, the second feedback capacitor Cfb may be charged with a voltage corresponding to a voltage corresponding to a leakage current in the second pixel PXij+1. Accordingly, an electric potential Vout_2 at the second operational amplifier OP-amp_2 may linearly increase according to the voltage corresponding to the leakage current in the second pixel PXij+1.

Referring again to FIGS. 4 and 5, during the second measurement period Ssen_2, the i-th sensing signal SEi may be inverted to its high level and may thus turn off the sensing transistors MS_2 of the first and second pixels PXij and PXij+1. The feedback control signal fb may maintain its low level and may thus continuously turn off the first and second feedback switches SW_fb. The first and second control signals ϕ1 and ϕ2 may maintain their high level, and may thus continuously turn on the first switch SW1 and the second switch SW2 of the current measurement unit 121. The i-th scan signal Si may maintain its high level and may thus turn off the switching transistors MS_1 of the first and second pixels PXij and PXij+1. The third control signal ϕ3, the first initialization signal Re1, and the second initialization signal Re2 may maintain their low level, and may thus continuously turn off the third switches SW3 of the data driving unit 123 and the first initialization switches SW_Re1 and the second initialization switches SW_Re2 of the current measurement unit 121. A control signal SH, which activates the correlated double sampling unit 121*c*, may be inverted to its high level, and as a result, the correlated double sampling unit 121*c* may perform CDS on the output signals of the first and second measurement circuits 121*a* and 121*b*, e.g., the first and second output voltages Vout_1 and Vout_2. For example, the correlated double sampling unit 121*c* may receive the output signals of the first and second operational amplifiers OP-amp_1 and OP-amp_2 with the voltages stored in the first and second operational amplifiers OP-amp_1 and OP-amp_2, respectively, e.g., the first and second output voltages Vout_1 and Vout_2, until the sensing transistors MS_2 of the first and second pixels PXij and PXij+1 are turned off. Thereafter, the correlated double sampling unit 121*c* may extract a difference in electric potential between the first and second output voltages Vout_1 and Vout_2, and may provide the extracted electric potential difference to the ADC 122*a* via the multiplexer 122*b*. The voltage stored in the output terminal of the first operational amplifier OP-amp_1 may be sampled as the first output voltage Vout_1, and the voltage stored in the output terminal of the second operational amplifier OP-amp_2 may be sampled as the second output voltage Vout_2. Thereafter, the electric potential difference between the first and second output voltages Vout_1 and Vout_2 may be extracted. For example, the first output voltage Vout_1 may be represented as the sum of the voltage corresponding to the current flowing in the OLED of the first pixel PXij and the voltage corresponding to the leakage current in the first pixel PXij, and the second output voltage Vout_2 may be represented as the voltage corresponding to the leakage current in the second pixel PXij+1. Since the voltage corresponding to the leakage current in the first pixel PXij is substantially the same as (or equal to) the voltage corresponding to the leakage current in the second pixel PXij+1, the electric potential difference between the first and second output voltages Vout_1 and Vout_2 may be represented as the voltage corresponding to the current flowing in the OLED of the first pixel PXij to which the first reference voltage Vset1 is applied. Accordingly, the leakage currents in the first and second pixels PXij and PXij+1, respectively, may be eliminated or substantially eliminated. Thereafter, a control signal "ADC", which activates the ADC 122*a*, may be inverted to its high level, and as a result, the ADC 122*a* may convert the output signal of the correlated double sampling unit 121*c* into a digital output signal ADC_OUT, and may provide the digital output signal ADC_OUT to the timing controller 130 of FIG. 1. The timing controller 130 may receive the digital output signal ADC_OUT from the ADC 122*a*, and may compensate for the j-th and (j+1)-th data signals Dj and Dj+1 based on the digital output signal ADC_OUT.

Referring again to FIG. 5, before the display period E, the third control signal ϕ3 may be inverted to its high level and may thus turn on the third switches SW3 of the data driving unit 123. Thereafter, during the display period E, the i-th scan signal Si may be inverted to its low level and may thus, turn on the first switching transistors MS_1 of the first and second pixels PXij and PXij+1. The first power source ELVDD may be increased to its original voltage level from the voltage level of the second power source ELVSS. For this, in each of the first and second pixels PXij and PXij+1, the power switch SW_P may connect the signal path between the first electrode of the driving transistor MD and the first power source ELVDD.

Figure 9:
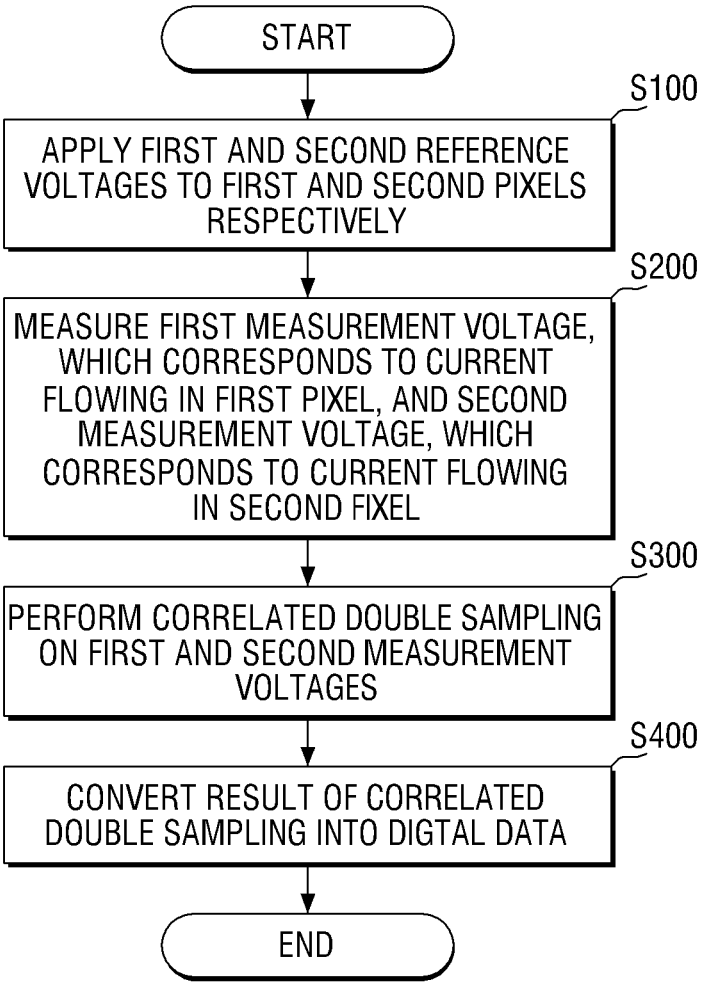
FIG. 9 is a flowchart illustrating a method of driving an organic light-emitting display device, according to an exemplary embodiment of the invention.

FIG. 9 is a flowchart illustrating a method of driving an organic light-emitting display device according to an exemplary embodiment of the invention.

Referring to FIGS. 5 and 9, during the reference voltage supply period Sset of the sensing period S, the first reference voltage Vset1 may be applied to the anode electrode of the OLED of one of the plurality of pixels, for example, the anode electrode of the OLED of the first pixel PXij. The second reference voltage Vset2, which has a different level from the first reference voltage Vset1, may be applied to the anode electrode of the OLED of another one of the plurality of pixels, for example, the anode electrode of the OLED of the second pixel PXij+1 (S100). The first reference voltage Vset1 may be a voltage corresponding to both a signal and noise. For example, the first reference voltage Vset1 may be greater than the threshold voltage Vth of the OLED of the first pixel PXij. The second reference voltage may be a voltage corresponding to noise. For example, the second reference voltage Vset2 may be greater than the threshold voltage Vth of the OLED of the second pixel PXij+1.

During the first measurement period Ssen_1 of the measurement period Ssen, a first measurement voltage corresponding to a current flowing in the first pixel PXij to which the first reference voltage Vset1 is applied, and a second measurement voltage corresponding to a current flowing in the second pixel PXij+1 to which the second reference voltage Vset2 is applied may be measured (S200). The first measurement voltage may be a voltage sampled from the voltage stored in the output terminal of the first operational amplifier OP-amp_1. The second measurement voltage may be a voltage sampled from the voltage stored in the output terminal of the second operational amplifier OP-amp_2. As discussed above, since no current flows in the OLED of the second pixel PXij+1, unlike in the OLED of the first pixel PXij, the second measurement voltage may not include a voltage corresponding to a current flowing in the OLED of the second pixel PXij+1.

During the second measurement period Ssen_2, the correlated double sampling unit 121*c* may perform CDS on first and second output voltages output by the first and second measurement circuits 121*a* and 121*b*, respectively (S300). Thereafter, in response to the control signal "ADC", which activates the ADC 122*a*, being inverted to its high level, the ADC 122*a* may convert the output signal of the correlated double sampling unit 121*c* into a digital output signal ADC_OUT, and may provide the digital output signal ADC_OUT to the timing controller 140 of FIG. 1 (S400).

The timing controller, data driver, scan driver and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or the like. Further, the various components of these devices may be a process or thread, running on one or more processors, in one or more computing devices, executing computer program instructions and interacting with other system components for performing the various functionalities described herein. The computer program instructions may be stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirt and scope of the exemplary embodiments of the present invention.

While some embodiments of the invention have been shown and described with reference to exemplary embodiments, the exemplary embodiments should be considered in a descriptive sense only and not for purposes of limitation. Accordingly, it will be understood by those of ordinary skill in the art that various changes may be made therein without departing from the spirit and scope of the invention as defined by the following claims and their equivalents.

What is claimed is:

1. An organic light-emitting display device, comprising:

a plurality of pixels, each of the pixels comprising an organic light-emitting diode (OLED);

a data driver comprising a plurality of current measurers connected to the plurality of pixels via at least one data line, each of the current measurers comprising:

a first measurement circuit comprising:

a first operational amplifier comprising a non-inverted input terminal to which a first reference voltage is applied, and an inverted input terminal connected to a first pixel from among the plurality of pixels; and a first feedback capacitor connected between the inverted input terminal and an output terminal of the first operational amplifier; and a second measurement circuit comprising:

a second operational amplifier comprising a non-inverted input terminal to which a second reference voltage having a different level from that of the first reference voltage is applied, and an inverted input terminal connected to a second pixel from among the plurality of pixels; and a second feedback capacitor connected between the inverted input terminal and an output terminal of the second operational amplifier; and a power supply connected to first and second power sources via power lines, wherein each of the plurality of pixels comprises:

a driving transistor comprising a first electrode connected to the first power source, and a second electrode connected to the second power source via the OLED that is connected to a first node;

a switching transistor comprising a first electrode connected to the data line, a second electrode connected to a gate electrode of the driving transistor, and a gate electrode connected to a scan line;

a sensing transistor comprising a first electrode connected to the data line, a second electrode connected to the first node, and a gate electrode connected to a sensing line; and a first capacitor comprising a first terminal connected to the first electrode of the driving transistor, and a second terminal connected to the gate electrode of the driving transistor, and wherein each of the current measurers further comprises:

a first initialization switch connected between the power supply and the data line connected to the plurality of pixels; and a second initialization switch connected between the power supply and the first electrode of the switching transistor.

2. The organic light-emitting display device of claim 1, wherein each of the current measurers further comprises a correlated double sampling unit connected to the output terminals of the first and second operational amplifiers.

3. The organic light-emitting display device of claim 2, wherein the data driver further comprises a data processor comprising:

an analog-to-digital converter (ADC) configured to convert an output of the correlated double sampling unit into digital data; and a multiplexer connected between the correlated double sampling unit and the ADC.

4. The organic light-emitting display device of claim 1, wherein:

the first measurement circuit further comprises a first feedback switch connected in parallel to the first feedback capacitor between the inverted input terminal and the output terminal of the first operational amplifier; and the second measurement circuit further comprises a second feedback switch connected in parallel to the second feedback capacitor between the inverted input terminal and the output terminal of the second operational amplifier.

5. The organic light-emitting display device of claim 1, wherein:

the first measurement circuit further comprises a first switch connected between the first pixel and the inverted input terminal of the first operational amplifier; and the second measurement circuit further comprises a second switch connected between the second pixel and the inverted input terminal of the second operational amplifier.

6. The organic light-emitting display device of claim 1, wherein the first reference voltage is greater than or equal to a threshold voltage of the OLED, and the second reference voltage is less than the threshold voltage of the OLED.

7. The organic light-emitting display device of claim 1, wherein each of the plurality of pixels further comprises a power switch connected between a power line connected to the first electrode of the driving transistor and the first and second power sources.

8. An organic light-emitting display device, comprising:

a plurality of pixels, each of the pixels comprising an OLED;

a data driver comprising a plurality of current measurers configured to measure a current flowing in each of the plurality of pixels during a sensing period, each of the current measurers being further configured to:

apply a first reference voltage to an anode electrode of an OLED included in a first pixel from among the plurality of pixels and a second reference voltage, which has a different level from that of the first reference voltage, to an anode electrode of an OLED included in a second pixel from among the plurality of pixels, during a reference voltage supply period of the sensing period; and measure a first measurement voltage corresponding to a current flowing in the first pixel to which the first reference voltage is applied and a second measurement voltage corresponding to a current flowing in the second pixel to which the second reference voltage is applied, during a measurement period of the sensing period, which follows the reference voltage supply period, wherein each of the plurality of pixels comprises:

a driving transistor configured to control a driving current flowing in the OLED connected between a first power source and a second power source;

a switching transistor configured to provide a data signal provided via a data line to a gate electrode of the driving transistor according to a scan signal provided to a gate electrode of the switching transistor;

a sensing transistor configured to measure a current flowing in the OLED according to a sensing signal provided to a gate electrode of the sensing transistor; and a first capacitor comprising a first terminal connected to a second electrode of the driving transistor, and a second terminal connected to the gate electrode of the driving transistor; and a power supply configured to charge the data line with a first initialization voltage via a first initialization switch connected between the power supply and the data line during a first initialization period of the sensing period, and to charge the first capacitor with a second initialization voltage via a second initialization switch connected between the power supply and a first electrode of the switching transistor during a second initialization period of the sensing period, which follows the first initialization period.

9. The organic light-emitting display device of claim 8, wherein each of the current measurers comprises:

a first measurement circuit comprising:

a first operational amplifier comprising a non-inverted input terminal to which the first reference voltage is applied, and an inverted input terminal connected to the first pixel;

a first feedback capacitor connected between the inverted input terminal and an output terminal of the first operational amplifier; and a first feedback switch connected in parallel to the first feedback capacitor between the inverted input terminal and the output terminal of the first operational amplifier;

a second measurement circuit comprising:

a second operational amplifier comprising a non-inverted input terminal to which the second reference voltage is applied, and an inverted input terminal connected to the second pixel;

a second feedback capacitor connected between the inverted input terminal and an output terminal of the second operational amplifier; and a second feedback switch connected in parallel to the second feedback capacitor between the inverted input terminal and the output terminal of the second operational amplifier; and a correlated double sampler configured to perform correlated double sampling (CDS) on the first and second measurement voltages provided at the output terminals of the first and second operational amplifiers, respectively.

10. The organic light-emitting display device of claim 9, wherein the data driver further comprises:

a data processor comprising an ADC configured to convert an output of the correlated double sampler into digital data, and a multiplexer configured to provide the output of the correlated double sampler to the ADC via a switching operation; and a data driving circuit configured to provide a data signal to the plurality of pixels during a display period.

11. The organic light-emitting display device of claim 10, wherein:

the first measurement circuit further comprises a first switch connected between the first pixel and the inverted input terminal of the first operational amplifier;

the second measurement circuit further comprises a second switch connected between the second pixel and the inverted input terminal of the second operational amplifier; and the data driving circuit comprises a plurality of digital-to-analog converters (DACs) configured to provide the data signal to a data line, and a plurality of third switches connected between the plurality of pixels and the DACs.

12. The organic light-emitting display device of claim 8, wherein the first reference voltage is greater than or equal to a threshold voltage of the OLED, and the second reference voltage is less than the threshold voltage of the OLED.

13. The organic light-emitting display device of claim 8, wherein each of the plurality of pixels further comprises a power switch configured to connect a power line connected to the first power source to the second power source via a switching operation.

14. A method of driving an organic light-emitting display device, the method comprising:

during a reference voltage supply period of a sensing period, applying a first reference voltage to an anode electrode of an OLED included in a first pixel from among a plurality of pixels, and applying a second reference voltage, which has a different level from that of the first reference voltage, to an anode electrode of an OLED included in a second pixel from among the plurality of pixels;

during a measurement period of the sensing period, which follows the reference voltage supply period, measuring a first measurement voltage corresponding to a current flowing in the first pixel to which the first reference voltage is applied, and measuring a second measurement voltage corresponding to a current flowing in the second pixel to which the second reference voltage is applied;

connecting a power line connected to a first power source to a second power source via a switching operation;

charging at least one data line with a first initialization voltage via a first initialization switch connected between a power supply and a data line connected to the plurality of pixels during a first initialization period of the sensing period; and charging first capacitors of the first and second pixels with a second initialization voltage via a second initialization switch connected between the power supply and a switching transistor during a second initialization period of the sensing period, which follows the first initialization period.

15. The method of claim 14, further comprising:

performing CDS on the first and second measurement voltages; and converting a result of the CDS into digital data.

* * * * *